US005608982A

United States Patent [19]

Bouvard et al.

[11] Patent Number: 5,608,982

[45] Date of Patent: Mar. 11, 1997

[54] METHOD AND APPARATUS FOR AN ELECTRIC ARC FIRING SYSTEM FOR CASELESS AMMUNITION

[75] Inventors: Franck Bouvard, Bourges; Françoise Simon, Plaimpied, both of France

[73] Assignee: Giat Industries, Versailles, France

[21] Appl. No.: 567,584

[22] Filed: Dec. 5, 1995

[30] Foreign Application Priority Data

Dec. 12, 1994 [FR] France ..... 94 14912

[51] Int. Cl.[6] ..... F41A 19/00

[52] U.S. Cl. ..... 42/84; 89/28.05; 89/135; 102/431

[58] Field of Search ..... 42/84; 89/135, 89/28.05; 102/431–433, 700, 472

[56] References Cited

U.S. PATENT DOCUMENTS

| | | | |
|---|---|---|---|
| 2,677,803 | 5/1954 | Rork | 102/472 |
| 3,299,812 | 1/1967 | Suh et al. | 89/28.05 |
| 3,685,392 | 8/1972 | Platt | 42/84 |
| 3,714,728 | 2/1973 | Perkins et al. | 42/84 |
| 3,730,094 | 5/1973 | Quinlan | 102/431 |
| 3,748,770 | 7/1973 | Mitchell | 42/84 |
| 3,777,387 | 12/1973 | Ritchey | 42/84 |
| 3,779,167 | 12/1973 | Irish, Jr. et al. | 102/431 |
| 3,859,746 | 1/1975 | Pecksen | 42/84 |
| 4,207,796 | 6/1980 | Warnock . | |
| 4,213,392 | 7/1980 | Usel | 102/431 |
| 4,377,113 | 3/1983 | Florence . | |
| 4,481,859 | 11/1984 | Dix | 89/135 |
| 5,074,189 | 12/1991 | Kurtz | 89/135 |
| 5,301,448 | 4/1994 | Petrick et al. . | |

FOREIGN PATENT DOCUMENTS

| | | | |
|---|---|---|---|
| 3237483 | 5/1984 | Germany . | |
| 3836721 | 10/1991 | Germany . | |
| 1123089 | 8/1968 | United Kingdom | 102/472 |
| 1140604 | 1/1969 | United Kingdom | 102/472 |
| 2072811 | 10/1981 | United Kingdom | 42/84 |
| 2234335 | 1/1991 | United Kingdom . | |
| 2241563 | 9/1991 | United Kingdom . | |

*Primary Examiner*—Harold J. Tudor
*Attorney, Agent, or Firm*—Oliff & Berridge

[57] ABSTRACT

A firing system for a small firearm including a caseless munition of a small calibre that is discharged by an electric arc in the vicinity of the primer of the munition from a high voltage applied between two electrodes. The electrode forming the anode is mounted on a support fastened to the rear of a firing chamber. The support ensures sealing for the combustive gases and insulation for the anode. The electrode forming the cathode is constituted by the metallic firing chamber of the weapon.

15 Claims, 2 Drawing Sheets

METHOD AND APPARATUS FOR AN ELECTRIC ARC FIRING SYSTEM FOR CASELESS AMMUNITION

The technical scope of the present invention is that of firing systems for small-calibre caseless ammunition, in particular for small fire arms.

BACKGROUND OF THE INVENTION

In conventional small fire arms, the ammunition is initiated by the percussion of a primer which triggers the firing of the propellant charge of the ammunition. The firing pin of the weapon, activated either by a mechanical or electric means, crushes the primer fixed to the base of the ammunition cartridge. When cased ammunition, is replaced by caseless ammunition, the problem of sealing for the combustive gases inevitably arises. In fact, the firing pin is a projecting mobile element in the weapon chamber where the high pressure may reach $5.10^8$ Pa, which makes it difficult to seal.

SUMMARY OF THE INVENTION

The aim of the invention is to design a firing system that may notably reduce this sealing problem to enable caseless ammunition to be fired from small fire arms, and wherein the architecture and constitutive materials also fulfill the requirements so thermo-mechanical strength at combustive gas instant temperatures of somewhere in the region of 2500° C.

To this end, the invention proposes a firing system for caseless ammunition, notably of small-calibre for a small fire arm, by discharge of an electric arc produced in the vicinity of the ammunition primer by using a high voltage applied between two electrodes. The firing system is characterized in that the electrode forming the anode is mounted on a support fastened to the rear of the chamber. The support notably ensuring both sealing for the combustive gases and electrical insulation for the anode. Further, the electrode forming the cathode is constituted by the metallic chamber of the weapon.

According to another characteristic of the invention, the anode support includes an electrically insulating cylindrical body that surrounds the electrode forming the anode, a ring made of an elastically deformable material mounted around the insulating body, and a ring-shaped cap fitted around the ring.

According to another characteristic of the invention, the electrode forming the anode, the insulating body, the intermediate ring and the cap are assembled together by brazing.

An example of the materials used to make up the anode support can include:

- the insulating body is made of a good heat conducting material such as ceramic and in particular an aluminium-based ceramic,
- the intermediate ring is made of a relatively soft material such as stainless steel notably to absorb the mechanical stresses transmitted to the insulating body after initiation of the ammunition, and
- the fastening cap for the anode support is made of steel and is screwed to the rear of the chamber.

According to other characteristics of the invention, the electrode forming the anode is a cylindrical rod with a pointed end, preferably made of molybdenum and mounted in the centre of the insulating body so as to be axially aligned with the ammunition and opposite the primer. A metallic sealing foil is applied to the ammunition primer, and the surface area of the insulating body in contact with the ammunition is roughly the same as that of the ammunition base.

A first advantage of the invention lies in a system having sufficient properties to enable it to be used reliably and safely, in particular, without the risk of an inadvertant thermo-initiation.

Another advantage of the firing system according to the invention lies in its compactness.

Other characteristics and advantages of the invention will become apparent from reading the additional description given hereafter by way of non-exhaustive illustration and with references to the drawings.

DETAILED DESCRIPTION OF PREFERRED EMBODIMENTS

Figure 1:
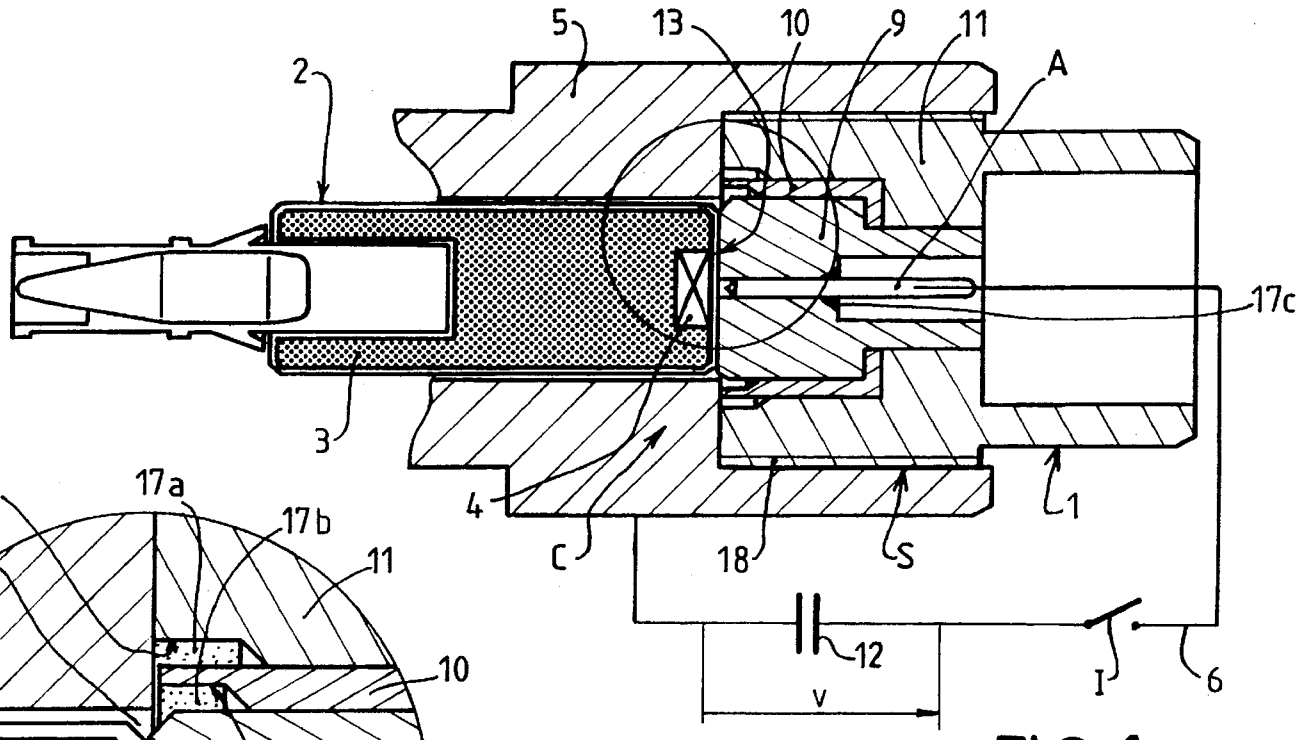
FIG. 1 is an axial section of the firing system according to the invention.
Figure 2:
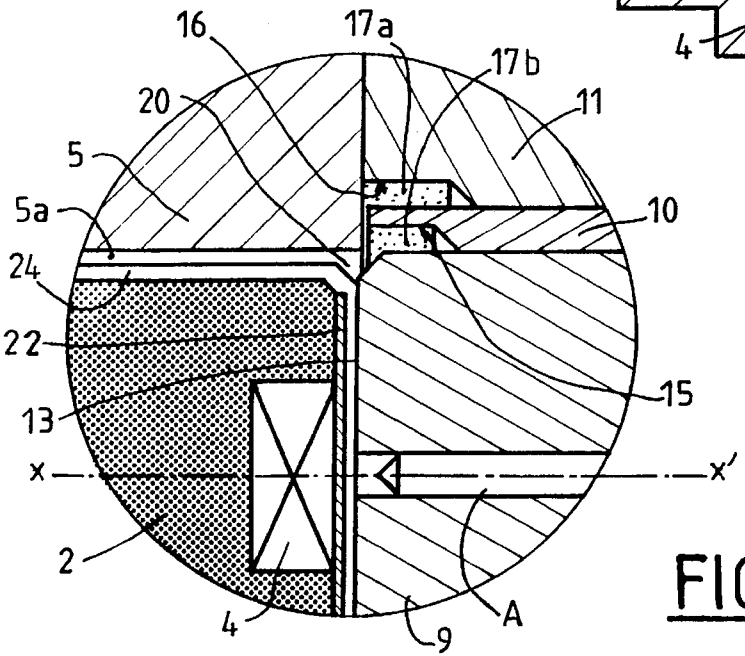
FIG. 2 is an enlargement of the detail circled in FIG. 1.

The firing system 1 shown in FIG. 1 is designed to initiate a caseless munition 2, whose propellant charge 3 is fired by a primer 4. The munition is positioned in a conventional manner in a firing chamber 5*a*, partly shown in FIG. 2 of a breech 5 of a fire arm.

The operation of this firing system 1 is based on the principle of the discharge of an electric arc produced in the vicinity of the primer 4 of the munition 2 from a high voltage applied between two electrodes, notably an anode A and a cathode C formed by the metallic firing chamber 5*a* of the weapon.

According to the embodiment shown in the figures, the anode A is mounted on a support S fastened to the rear of the chamber 5. This support includes an electrically insulating cylindrical body 9 which surrounds the anode A, an intermediate ring 10 fitted around the body 9 and a ring-shaped cap 11 surrounding the ring 10.

The anode A is a cylindrical rod which is mounted in the centre of the insulating body 9 so as to be axially aligned with the munition 2 and opposite the primer 4 whilst being slightly retracted inside the body 9. This anode A is made of molybdenum, a material that can withstand combustive gas corrosion, and has a pointed end to facilitate the formation of the electric arc.

The other end of the anode A is connected to the chamber 5 by means of an electrical circuit 6 comprising an electrical power supply 12, of the high voltage capacitor type, and a circuit breaker I.

The insulating body 9 is made of ceramic, in particular aluminium-based ceramic. The aluminum-based ceramics is chosen for its electrical properties that ensure the insulation of the anode A, for its thermal properties that ensure surface cooling of the part 13 of the ceramic in contact with the base of the munition 2 and for its mechanical properties that have good crushing strength. In fact, the excessive heating of the ceramic 9 surface in contact with the munition 2 could cause the thermo-initiation of the caseless munition 2. Moreover, the ceramic making up the insulating body 9 is subjected to the combustive gas pressure of the propellant charge 3, i.e. it is stressed mechanically upon each initiation and its cracking must be avoided. The ring 10 fitted between the insulating body 9 and the steel cap 11 is advantageously made of an elastically deformable material to as notably to absorb the mechanical stresses transmitted to the body 9 every time a munition 2 is initiated. This ring 10 is, for example, of a relatively soft material, such as stainless steel so as to homogenise the contact surfaces and avoid stress concentration due to surface irregularities. This provides better mechanical strength of the insulating body 9 and reduces the risk of ceramic cracking.

In a general manner, the anode A, the insulating body 9, the intermediate ring 10 and the cap 11 are assembled together by brazing in order to ensure sealing of the support S to the combustive gases. This brazing is referenced as 17*a*, 17*b* and 17*c* on FIGS. 1 and 2. To this end, the ring 10 and the cap 11 are both fitted with bevels 15 and 16 respectively leaving an empty space to accommodate the brazing joint.

The cap 11 is fitted with a threading 18 around its periphery that enables the support S to be fastened to the cathode C at the rear of the chamber 5*a*.

The structure thus constructed notably fulfils the requirements of high thermo-mechanical strength and sealing from the outside for the combustive gases necessary because the chamber 5*a* of the weapon is subjected to pressures of somewhere in the region of $5.10^8$ Pa for an instant combustive gas temperature of around 2500° C. over 1 ms.

When the munition is loaded into the chamber 5*a* and centred by its projectile in the weapon barrel, the munition 2 presses against the support S of anode A without any contact with the metallic side wall of the chamber 5. To this end, a lateral space 20 has been provided between the propellant charge and the inner wall of the chamber 5*a* to avoid the risk of thermo-initiation. The surface area 13 of the insulating body 9 of the support S against which the munition 2 presses is roughly the same as that of the munition 2 base.

To facilitate the dielectric burn-out between the primer 4 and the anode A, the application of a sealing foil 22 made of onion skin paper metallized, for example, with copper is provided over the full surface area of the munition 2 base. The metallized face of the sealing foil 22 being applied against the primer 4. The composition of the primer 4 must be sensitive to a spark, but insensitive to an impact or to friction. A known composition of model 4.5 Z may be used.

In addition, a protective coating 24 in the form of layers of varnish may be applied to all the outer surface area of the propellant charge 3 including on the metallized sealing foil 22 with the aim of ensuring the efficient protection of the latter against environmental stress.

The operation of the firing system 1 is described hereafter. When the order to fire a munition 2 is given, the circuit breaker I is closed to apply a high voltage electrical impulse of around 8 kV delivered by the capacitor 12 between the anode A and the cathode C, which is constituted by the chamber 5*a*. An electric arc is thereby formed and the capacitor 12 discharges almost in a short circuit along a path presenting the lowest dielectric strength. This path passes by the protective coating 24, the metallized sealing foil 22, the space 20 between the propellant charge 3 and the chamber 5*a*. The discharge of the capacitor 12 causes a burn-out between the anode A and the chamber 5*a*. The burn-out initiates the primer 4. The dissipation of the energy released at the metallized sealing foil 22 explodes locally to vaporize its metallized face. The metallic and thermal shock thus created is transmitted to the primer composition 4, which is initiated.

Naturally, the capacitor 12 is recharged after each initiation by a voltage V. According to the invention, the value of burn-out voltage required to initiate the primer 4 is calculated as around 8 kV, whereas the dielectric burn-out between anode A and the ring 10 would only occur at a voltage of over 20 kV, thereby constituting a safety factor.

Figure 3:
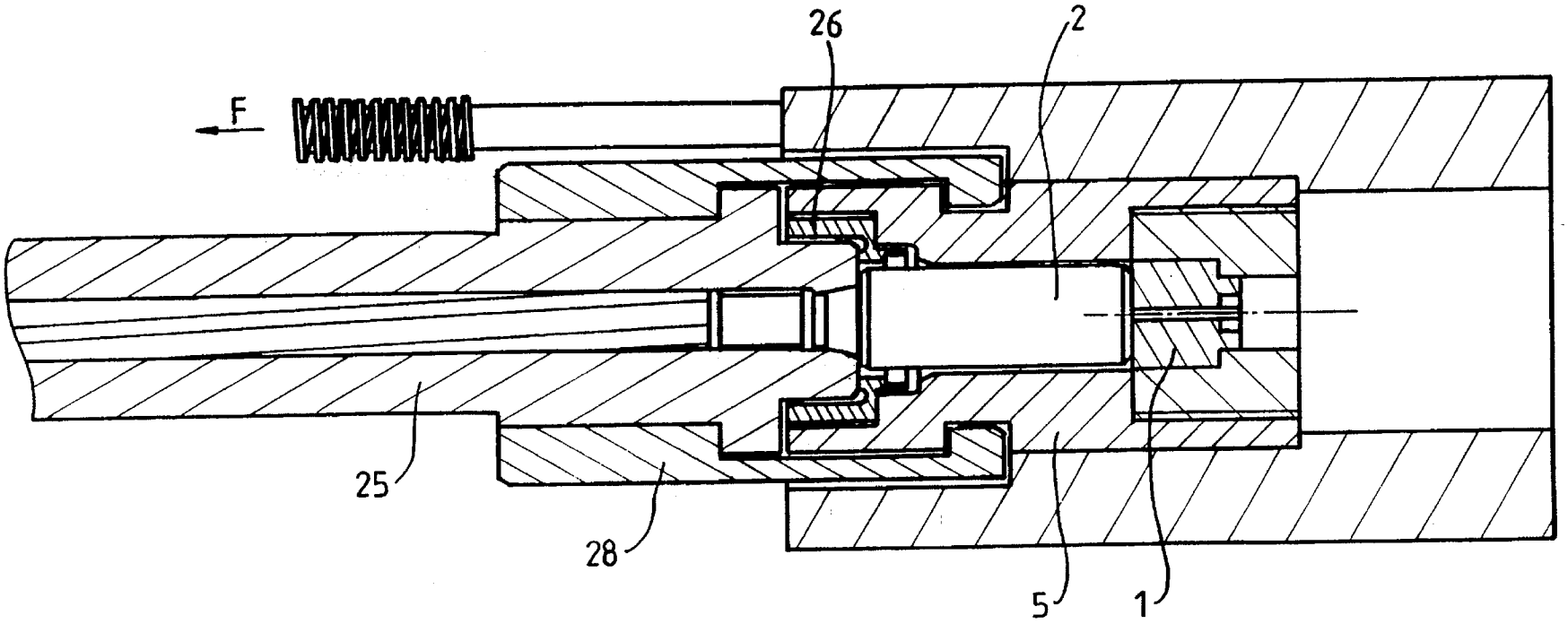
FIG. 3 is a section view showing the firing system incorporated into a small calibre fire arm.

In FIG. 3, the firing system 1 is shown incorporated into the breech 5 of a small calibre fire arm. The breech 5 is prolonged by the barrel 25, a seal 26 being placed between them. Lastly, a cylinder lock 28 bolts the barrel 25 to the breech 5 in a conventional manner.

We claim:

1. A firing system for a caseless munition having a primer, the caseless munition being discharged by an electric arc in a vicinity of the primer, the firing system comprising:

a firing chamber that supports the munition;

an anode;

a support fastened to a rear portion of the firing chamber to ensure sealing for combustive gases, the support including an electrically insulating cylindrical body surrounding the anode, such that a base of the munition in the chamber presses on a facing surface of the electrically insulating cylindrical body, a surface area of the facing surface being approximately equal to a surface area of the base of the munition, the support further including a ring made of an elastically deformable material surrounding the electrically insulating cylindrical body and a ring shaped cap fitted around the rings; and a cathode electrically connected to the anode, the cathode including parts of the firing chamber.

2. The firing system according to claim 1, wherein the anode, the insulating cylindrical body, the ring and the cap are formed as an assembly by brazing.

3. The firing system according to claim 1, wherein the cap is threadedly engaged to the rear portion of the firing chamber.

4. The firing system according to claim 1, wherein the insulating cylindrical body is a heat conducting material.

5. The firing system according to claim 1, wherein the anode is made of molybdenum, the insulating cylindrical body is made of an aluminum-based ceramic material, the ring is made of stainless steel and the cap is made of steel.

6. The firing system accordingly to claim 1, wherein the anode includes a cylindrical rod having a pointed end, the anode being mounted in a central area of an insulating body and being axially aligned with the munition, the pointed end being adjacent the primer.

7. The firing system according to claim 1, further comprising a metallized sealing foil located between the primer and the anode.

8. The firing system according to claim 1, wherein the caseless munition is for a firearm.

9. A method of operating a firing system for a caseless munition having a primer, the firing system including an anode and a cathode, the cathode including at least parts of a metallic firing chamber housing the munition, comprising the steps of:

sealing a rear of the firing chamber with a support, the support providing sealing for combustive gases, the support including an electrically insulating cylindrical body such that a base of the munition in the chamber presses on a facing surface of the electrically insulating cylindrical body, a surface area of the facing surface being approximately equal to a surface area of the base of the munition, the support further including a ring made of an elastically deformable material surrounding the electrically insulating cylindrical body and a ring shaped cap fitted around the ring;

mounting an anode on the support such that the anode is surrounded by the electrically insulating cylindrical body; and discharging an electric arc between the anode and the cathode in a vicinity of the primer.

10. The method of claim 9, wherein the discharging step comprises the steps of:

applying a high voltage between the anode and the cathode; and generating the electric arc along a path of lowest dielectric, the path between the anode and the cathode including a protective coating of the munition, a metallized sealing foil and a space between a propellant charge and the firing chamber.

11. The method of claim 9, further comprising the step of electrically insulating the anode from the support.

12. The method of claim 9, wherein the sealing step comprises brazing together the anode, the insulating body, the ring and the cap to form an assembly.

13. The method according to claim 9, further comprising the step of igniting the primer with the electric arc.

14. The method of claim 9, wherein a burn out voltage necessary to ignite the primer is approximately 8 kV and a burn out voltage of the ring is approximately 20 kV.

15. A firing system for firing a caseless munition having a primer, the firing system including an anode electrode and a cathode electrode, one of the cathode and the anode including parts of a metallic firing chamber housing the munition, the firing system comprising:

sealing means for sealing a rear of the firing chamber, the sealing means providing sealing for combustive gases, the sealing means including an electrically insulating cylindrical body surrounding the other one of the cathode and the anode, such that a base of the munition in the chamber presses on a facing surface of the electrically insulating cylindrical body, a surface area of the facing surface being approximately equal to a surface area of the base of the munition, the sealing means further including a ring made of an elastically deformable material surrounding the electrically insulating cylindrical body and a ring shaped cap fitted around the ring; and discharging means for discharging an electric arc between the anode and the cathode in a vicinity of the primer.

* * * * *